United States Patent [19]

Gill

[11] Patent Number: 4,870,407

[45] Date of Patent: Sep. 26, 1989

[54] VIDEO DISPLAY APPARATUS

[75] Inventor: Bernard W. Gill, Earley, Great Britain

[73] Assignee: International Computers Limited, London, England

[21] Appl. No.: 146,023

[22] Filed: Jan. 20, 1988

[30] Foreign Application Priority Data

Feb. 3, 1987 [GB] United Kingdom ..... 8702358

[51] Int. Cl.[4] ..... G09G 1/16

[52] U.S. Cl. ..... 340/800; 340/749; 340/750; 340/799

[58] Field of Search ..... 340/735, 750, 798, 799, 340/703, 748, 800, 801

[56] References Cited

U.S. PATENT DOCUMENTS

| | | | |
|---|---|---|---|
| 4,504,828 | 3/1985 | Couper et al. | 340/735 |
| 4,646,077 | 2/1987 | Culley | 340/750 |
| 4,679,027 | 7/1987 | Higuchi | 340/735 |
| 4,703,322 | 10/1987 | Goss et al. | 340/750 |

*Primary Examiner*—Gerald Brigance

*Attorney, Agent, or Firm*—Lee & Smith

[57] ABSTRACT

Video display apparatus is described in which video data is held in a dynamic random-access memory (DRAM). In each cycle, one processor access and four video accesses are made to be DRAM. The video data is de-skewed, by feeding it through two registers in series, so as to ensure that the four video data words can be sampled at equally spaced intervals, equal to one-fourth of the cycle.

5 Claims, 2 Drawing Sheets

VIDEO DISPLAY APPARATUS

BACKGROUND OF THE INVENTION

This invention relates to video display apparatus. The invention also relates to a data processing system including a data processing unit and a video display device for displaying data from the processing unit.

More specifically, the invention is concerned with display apparatus in which the data to be displayed is stored in a display memory. During each cycle of operation, one processor access and a plurality of video accesses are made to the memory. During the processor access, the processing unit can update the data in the memory. In each video access, an item of data can be read out of the memory and fed to the display device.

A problem with this arrangement is that, because the processor access is interlaced with the video accesses, the video accesseses are skewed, i.e. they are all displaced towards one end of the cycle. Before the video data can be used by the display, it must first be de-skewed, to ensure that the data from the video accesses are available at equally spaced intervals. One way of doing this as described in U.S. Pat. No. 4 388 621 is to load the data from the video accesses into separate registers, and then to output the data from each of these registers in turn at equally spaced intervals.

One object of the invention is to provide an improved solution to the problem of de-skewing the video data.

SUMMARY OF THE INVENTION

According to the invention, there is provided video display apparatus comprising:

(a) a display device, (b) a memory, (c) means operable in a predetermined cycle to perform n+1 accesses to the memory during each cycle, one of the accesses being a processor access and the other n accesses being video accesses, and (d) first and second registers, connected in series between the output of the memory and the input of the display device, (e) means for dividing each cycle into n+1 sub-cycles and for loading data from said n+1 memory accesses into the second register from the first register in respective ones of said n+1 sub-cycles, and (f) means for dividing each cycle into n sub-cycles of equal duration and for reading data from said n video accesses from the second register in respective ones of said n sub-cycles.

It can be seen that the invention de-skews the data by feeding it through two registers connected in series, rather than by using separate registers for holding the data from each video access. In general, this requires less hardware and simplifies the logic. Another advantage of the invention is that it permits a character look-up table to be accessed in the time interval between the clocking of the two registers, and hence speeds up the operation of the apparatus.

BRIEF DESCRIPTION OF THE DRAWINGS

One embodiment of the invention will now be described by way of example with reference to the accompanying drawings.

DESCRIPTION OF AN EMBODIMENT OF THE INVENTION

Figure 1:
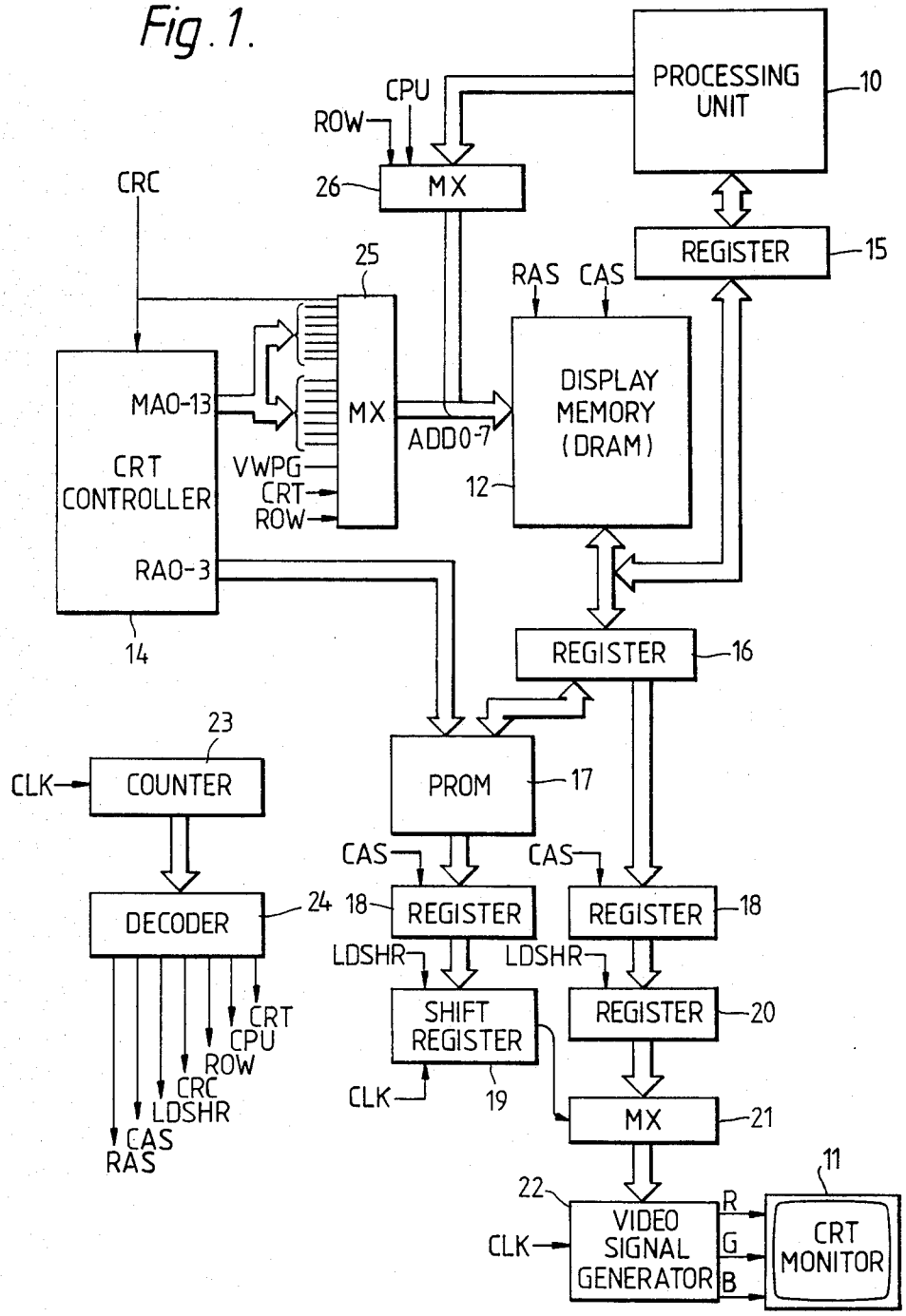
FIG. 1 shows a processing system including data display apparatus.

Referring to FIG. 1, the data processing system comprises a data processing unit 10. Data from the processing unit can be displayed on a video display device which, in this example, consists of a conventional cathode ray tube (CRT) monitor 11.

The data to be displayed is stored in a display memory 12. This comprises a dynamic random-access memory (DRAM) containing 64K individually addressable 16-bit word locations. The memory 12 is a conventional row/column organised memory, having internal row and column address registers. The row address register is loaded with an 8-bit row address from an input address path ADD0-7, at the falling edge of a row address strobe signal RAS. Similarly, the column address register is loaded with an 8-bit column address from ADD0-7 at the falling edge of a column address strobe signal CAS. The contents of the row and column address registers together select one word in the memory for reading or writing.

The addresses on the address path ADD0-7 are derived from the processing unit 10, in the case of processor accesses, or from a conventional CRT controller 14, in the case of video accesses. For example, the controller 14 may be a Fujitsu MB 89321 single-chip CMOS device.

Each 16-bit word in the memory 12 consists of two 8-bit bytes. The first byte represents the identity of a character to be displayed, while the second byte represents one or more attributes of that character. In this particular example, the second byte consists of two 4-bit colour codes. The first of these codes represents the foreground colour (i.e. the colour of the character itself) while the second code represents the background colour (i.e. the colour surrounding the character).

The currently addressed location of the memory 12 can be accessed, by way of a 16-bit register 15, by the processing unit 10, allowing the processing unit to read the contents of the location or to write new data into that location.

The output of the currently addressed location of the memory is also clocked into a 16-bit register 16 at the next rising edge of the CAS signal.

The first byte of the register 16, representing the character code, is connected to the address input of a character look-up table, consisting of a programmable read-only memory (PROM) 17. The address input of the PROM 17 also receives a character line address RA0-3 from the CRT controller 14, indicating which raster line of the character is currently being scanned. The data output of the character PROM 17 is an 8-bit word, indicating display values for the eight successive picture elements (pixels) making up the portion of the selected character in the current scan line.

The output of the character PROM 17, and the second byte of the register 16, are clocked into a sixteen-bit register 18 at the next again rising edge of the CAS signal.

The first byte of the register 18 (containing the data from the character PROM 17) is clocked into an eight-bit shift register 19 by means of a shift register load control signal LDSHR. At the same time, the second byte of the register 18 (representing the character attributes) is gated into an eight-bit register 20.

The contents of the shift register 19 are then shifted out, one bit at a time, by means of a clock signal CLK, at the desired pixel rate of the display. In this particular example, the clock CLK has a frequency of 20 MHz. The output bit from the shift register 19 controls a multiplexer 21 which selects either the foreground or the background colour code from the register 20.

The selected 4-bit colour code from the multiplexer 21 is fed to a video signal generator circuit 22, which converts the code into one of sixteen pre-programmed colours, by generating the appropriate red, green and blue (RGB) video signals for the CRT monitor 11.

The CRT controller 14 is programmable to produce a sequence of 14-bit memory addresses MA0-13. The controller 14 is driven by a clock signal CRC such that, at each falling edge of CRC, a new memory address MA0-13 is produced, except during blanking periods.

The address path ADD0-7 of the DRAM 12 is connected to the output of a multiplexer 25. This can be enabled by a signal CRT which permits the CRT controller 14 to access the DRAM. When enabled, the multiplexer 25 alternatively selects two eight-bit inputs, according to the value of a control signal ROW. When ROW is low, the multiplexer selects a column address, the least significant bit of which consists of the clock signal CRC and the other seven bits of which consist of the signals MA 0–2, MA 7–10 from the controller 14. Conversely, when ROW is high, the multiplexer selects a row address, the most significant bit of which consists of a control signal VWPG which selects between two possible pages for display, and the remaining seven bits of which consist of the signals MA 3–6, MA 11–13 from the controller.

It can be seen that, since the column address supplied to the DRAM via the multiplexer 25 has the clock signal CRC as its least significant bit, the column address has two different values in each period of CRC. Hence, two different locations in the DRAM are addressed for each value of the address MA 0–13 from the controller.

The address path ADD0-7 of the DRAM 1.2 is also connected to the output of a multiplexer 26. This can be enabled by a signal CPU, which permits the processing unit 10 to access the DRAM. When enabled, the multiplexer 26 alternately selects either a row address or a column address from the processing unit 10, according to the value of the signal ROW.

The pixel rate clock signal CLK drives a 5-bit counter 23, which defines a 32-beat cycle of operation for the apparatus. The contents of this counter are decoded by a decoder circuit 24 to produce various control signals during the cycle, including the signals RAS, CAS, LDSHR, CRC, ROW, CPU and CRT mentioned above.

Figure 2:
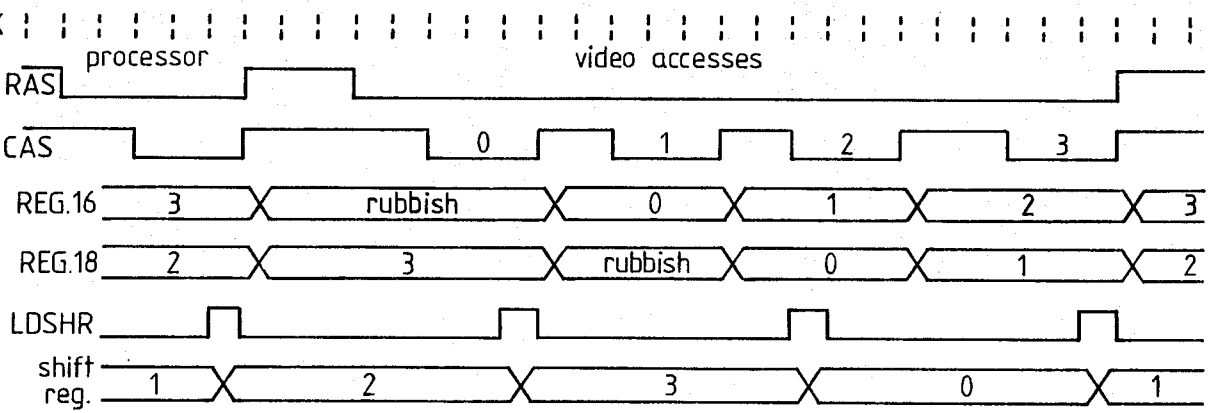
FIGS. 2 and 3 are timing diagrams illustrating the operation of the apparatus.

Referring now to FIG. 2, this is a timing diagram showing one of these cycles of operation. In each cycle, one processor access and four video accesses (0–3) are made to the display memory DRAM 12.

At the first falling edge of RAS in each cycle, a row address from the processing unit 10 is strobed into the memory 12. Then, at the falling edge of CAS, a column address from the processing unit is strobed into the memory. The addressed location of the memory can then be accessed by the processing unit.

At the next falling edge of RAS, a row address from the CRT controller 14 is strobed into the memory 12. Then, at the next four falling edges of CAS, four successive column addresses are strobed from the controller 14. Thus, four successive locations in the memory are accessed, all these locations having the same row address but having different column addresses. These are the four video accesses (0–3).

It can be seen that the data from these four video accesses is skewed, in the sense that the accesses all take place towards one end of the cycle, and are therefore not equally spaced through the cycle.

The data read from the memory in each video access is clocked into the register 16 at the first rising edge of CAS following the access. Then, at the next rising edge of CAS, the data is clocked into the register 18. In the interval between the clocking of the two registers 16, 18, the first byte of the data is converted by the character look-up table 17. It should be noted that the data appearing at the output of the memory during the processor access is also clocked through the registers 16, 18. However, this data is not intended to be displayed, and hence is regarded as "rubbish" when it passes through the registers 16, 18.

FIG. 2 also shows the signal LDSHR which clocks the output of the register 18 into the shift register 19 and the register 20. As can be seen, this signal LDSHR occurs at equally spaced intervals of eight beats of the clock CLK, four times in each cycle. The signal LDSHR is aligned with the data in register 18 in such a manner that it samples the data from the four video accesses, but ignores the "rubbish" data.

In summary, it can be seen that the signal CAS divides each cycle into five sub-cycles, in which the data from the five memory accesses (one processor access and four video accesses) are respectively loaded into the register 18. The signal LDSHR divides each cycle into four equal sub-cycles, in which the data from the four video accesses is read out of the register 18. The video data is thus de-skewed, and the "rubbish" data is discarded.

Figure 3:
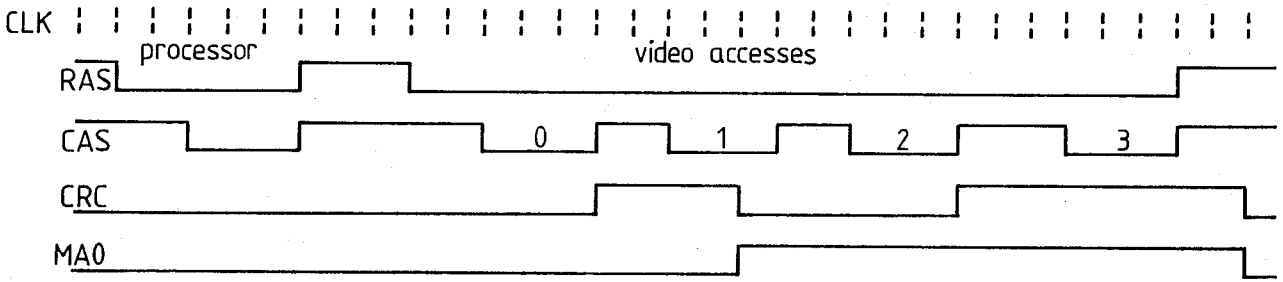

Referring now to FIG. 3, this again shows the signals CLK, RAS and CAS, and shows the clock signal CRC which drives the CRT controller. At each falling edge of CRC, the CRT controller increments its memory address MA0-13, as illustrated by the least significant bit MAO of this address.

It can be seen that, for each value of the address MA 0–13, the clock signal CRC has two values: first low and then high. Hence, two locations of the display memory are accessed for each value of the address MA 0–13; in other words, the display memory is addressed at twice the rate of operation of the CRT controller. Moreover, the potential address range of the CRT controller is doubled by the extra address bit CRC.

I claim:

1. Video display apparatus comprising:

(a) a display device, (b) a memory, (c) means operable in a predetermined cycle to perform n+1 accesses to the memory during each cycle, one of the accesses being a processor access and the other n accesses being video accesses, n being greater than one, (d) first and second registers, connected in series between the output of the memory and the input of the display device, (e) means for dividing each cycle into n+1 sub-cycles and for loading data from said n+1 memory accesses into the first register in respective ones of said n+1 sub-cycles, (f) means for transferring data from the first register to the second register in each of the said n+1 sub-cycles, and (g) means for dividing each cycle into n sub-cycles of equal duration and for reading data from said n video accesses from the second register in respective ones of said n sub-cycles.

2. Display apparatus according to claim 1 further including a character look-up table connected between said first and second registers.

3. Display apparatus according to claim 1 further including a shift register having a parallel input connected to said second register and a serial output connected to said display device.

4. Display apparatus according to claim 3 wherein said means for dividing each cycle into n sub-cycles comprises means for producing a load control signal occurring at equally spaced intervals equal to 1/nth of said cycle, the load control signal being connected to said shift register to control parallel loading of the shift register.

5. Display apparatus according to claim 1 wherein said memory is organised in rows and columns, and is controlled by a row address strobe signal and a column address strobe signal, and wherein said means for dividing each cycle into n+1 sub-cycles comprises means for applying said column address strobe signal as a load control signal to said first and second registers.

* * * * *